US008274357B2

(12) United States Patent
Chang

(10) Patent No.: US 8,274,357 B2
(45) Date of Patent: Sep. 25, 2012

(54) VARISTOR HAVING CERAMIC CASE

(75) Inventor: Bi-Yung Chang, Changhua County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 126 days.

(21) Appl. No.: 12/903,367

(22) Filed: Oct. 13, 2010

(65) Prior Publication Data

US 2011/0025450 A1 Feb. 3, 2011

Related U.S. Application Data

(63) Continuation-in-part of application No. 11/429,106, filed on May 8, 2006, now abandoned.

(51) Int. Cl.
*H01C 7/10* (2006.01)

(52) U.S. Cl. ..... 338/21; 338/226; 338/276

(58) Field of Classification Search ..... 338/21
See application file for complete search history.

(56) References Cited

U.S. PATENT DOCUMENTS

| | | | | |
|---|---|---|---|---|
| 5,036,420 | A * | 7/1991 | Yoshimura et al. | 361/118 |
| 5,233,326 | A * | 8/1993 | Motoyoshi | 338/22 R |
| 5,760,336 | A * | 6/1998 | Wang | 174/535 |
| 6,028,557 | A * | 2/2000 | Oka | 343/713 |
| 6,242,998 | B1 * | 6/2001 | Mihara | 338/22 R |
| 7,808,364 | B2 * | 10/2010 | Chou et al. | 338/21 |

* cited by examiner

*Primary Examiner* — Kyung Lee
(74) *Attorney, Agent, or Firm* — Rosenberg, Klein & Lee

(57) ABSTRACT

A varistor for protecting a power circuit from explosion and flaming is disclosed. The varistor includes a surge absorber sintered at a first predetermined temperature and having a plurality of electrodes, a plurality of leads connected to the electrodes respectively, a coating enrobing the surge absorber, and the ceramic case sintered at a second predetermined temperature and housing the surge absorber and the coating. The second predetermined temperature is higher than the first predetermined temperature. The ceramic case has a plurality of openings for the leads to extend outside of the ceramic case. The ceramic case is made from $Al_2O_3$, $SiO_2$ and MgO.

30 Claims, 5 Drawing Sheets

VARISTOR HAVING CERAMIC CASE

REFERENCE TO PRIOR NON-PROVISIONAL APPLICATION

This application is a continuation-in-part of U.S. patent application Ser. No. 11/429,106, filed May, 8, 2006, now abandoned.

BACKGROUND OF THE INVENTION

1. Field of the Invention

The present invention relates.

2. Description of Related Art

FIG. 1 shows a traditional varistor. The varistor 10 comprises a surge absorber 11, two electrodes 13 disposed on the opposite sides of the absorber 11, and two leads 15. In FIG. 1(*a*), only one of the electrodes 13 is illustrated, and the leads 15, usually made from tinned copper wires, are welded on the respective electrodes 13. In FIG. 1(*b*), the absorber 11 is embedded with a packaging resin 17 for damp-proof and insulation effects. The packaging resin 17 is usually epoxy resin.

For operation, the surge absorber 11 may protect the power circuit with grain boundary thereof. However, the surge absorber 11 very possibly reaches a high temperature when the surge absorber 11 is overloaded or ineffective, and therefore the outside packaging resin 17 would burn as flammability thereof. In addition, a flame from the burned packaging resin may damage to surrounding equipment close to the surge absorber 11.

SUMMARY OF THE INVENTION

One objective of the present invention is to provide a varistor having a ceramic case with enough mechanical strength and non-flammability so as to protect a power circuit from explosion and flaming.

The varistor comprises a surge absorber, two leads, a coating and a ceramic case. The surge absorber is made from metal oxide sintered at a first predetermined temperature and has two electrodes respectively connected to first ends of the leads conducting the surge current to the surge absorber from converting electricity into heat. The coating has good damp-proof and insulation properties and enrobes the surge absorber and the first ends of the leads. The ceramic case is preferably made from an insulated ceramic material sintered at a second predetermined temperature higher than the first predetermined temperature so as to the ceramic case has superior mechanical strength and non-flammability than the surge absorber when the surge absorber is overload. The surge absorber and the coating are accommodated in the ceramic case having two openings for the two leads to protrude from the ceramic case. As a result, the varistor may be secured with the ceramic case even though the surge absorber is ineffective.

Types or positions of the openings are not restricted, and preferably disposed corresponding to the leads. The ceramic case comprises a container and a cover. The openings may be formed on the cover or beneath the container opposite to the cover. Proper material for the ceramic case includes about Silicon dioxide ($SiO_2$), Magnesium Oxide (MgO) and 25 to 99 wt. % Aluminum Oxide ($Al_2O_3$).

Another proper material for the ceramic case includes Aluminum Oxide ($Al_2O_3$), Magnesium Oxide (MgO) and about 15 to 60 wt. % Silicon dioxide ($SiO_2$).

Another proper material for the ceramic case includes Aluminum Oxide ($Al_2O_3$), Silicon dioxide ($SiO_2$) and about 15 to 40 wt. % Magnesium Oxide (MgO).

In order to further understand the techniques, means and effects the present invention takes for achieving the prescribed objectives, the following detailed descriptions and appended drawings are hereby referred, such that, through which, the purposes, features and aspects of the present invention could be thoroughly and concretely appreciated; however, the appended drawings are merely provided for reference and illustration, without any intention to be used for limiting the present invention.

DETAILED DESCRIPTION OF THE PREFERRED EMBODIMENTS

Figure 1A:
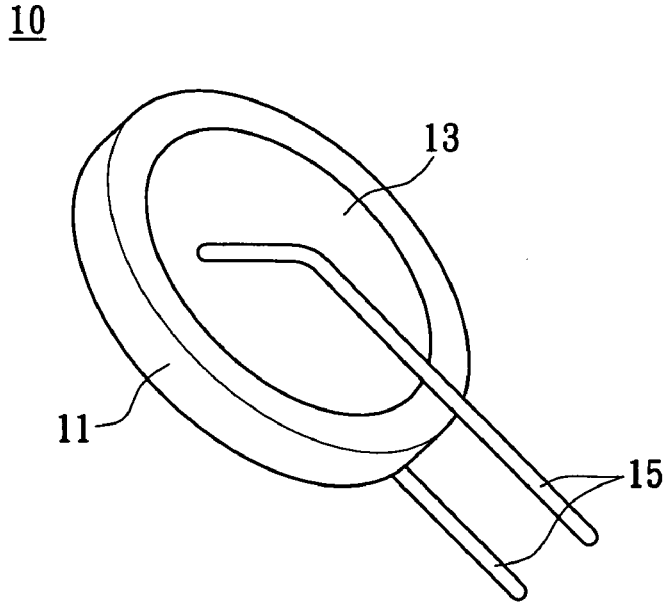
FIG. 1a(Prior Art)
FIGS. 1*a* and 1*b* are a schematic diagrams of a traditional varistor.
Figure 1B:
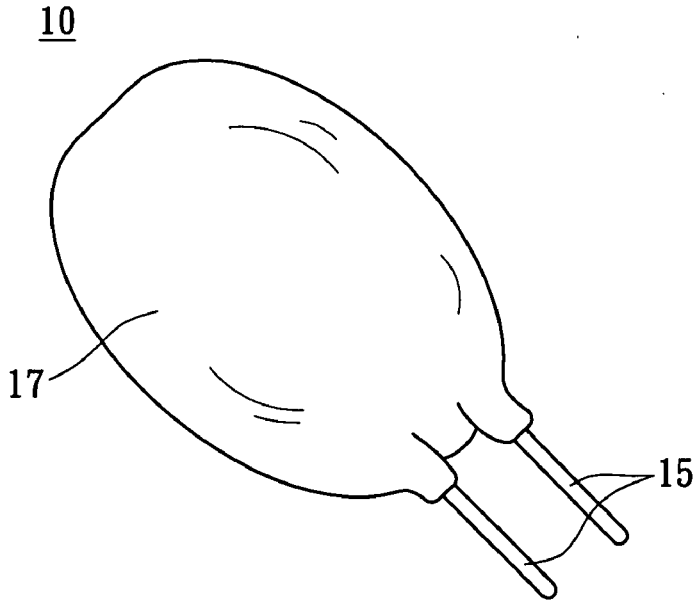
FIG. 1b(Prior Art)
Figure 2A:
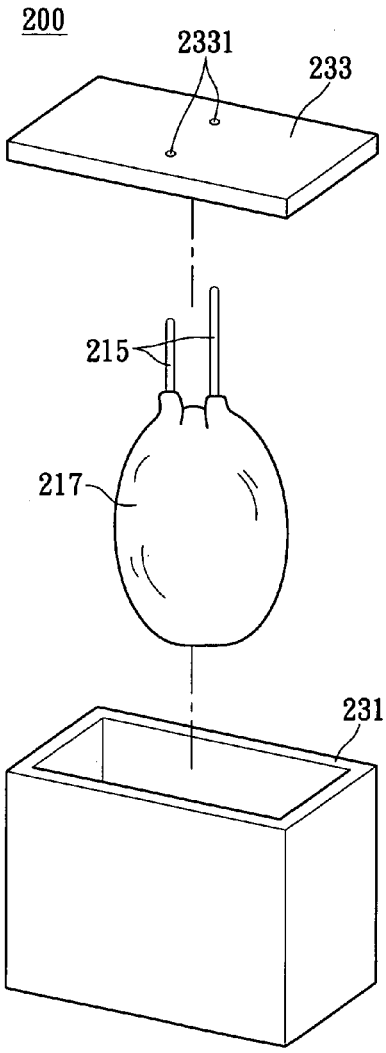
FIGS. 2*a*, 2*b* and 2*c* are a schematic diagram and a cross-sectional view of a varistor in accordance with a first embodiment of the present invention.
Figure 2B:
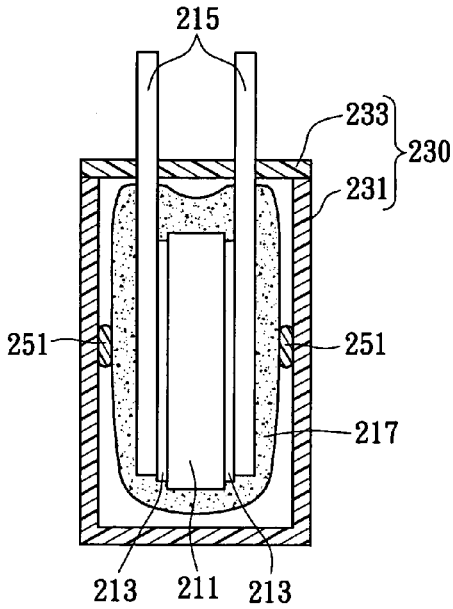
Figure 2C:
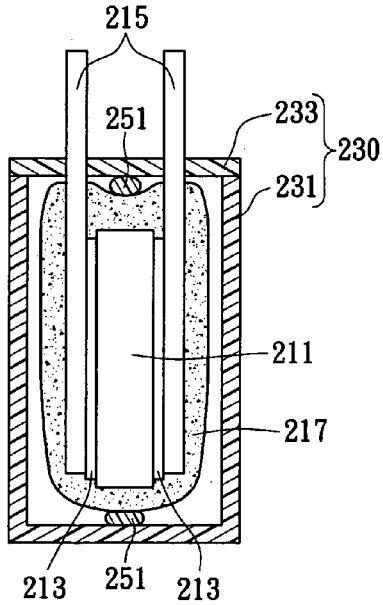

FIG. 2 is a schematic diagram and a cross-sectional view of a varistor in accordance with a first embodiment of the present invention.

The varistor 200 comprises a surge absorber 211 with a plurality of electrodes 213, a plurality of leads 215, a coating 217, and a ceramic case 230. In one implement, the plurality of electrodes 213 comprises a first electrode and a second electrode, and the plurality of leads 215 includes a first lead and a second lead. The first lead has a first end thereof attached to the first electrode by a silver weld. The second lead has a first end thereof attached to the second electrode by a silver weld. The coating 217 enrobes the surge absorber 211 and the two first ends of the leads 215.

The ceramic case 230 comprises a container 231 and a cover 233. The cover 233 is connected to the container 231 so as to form a sealed space. The surge absorber 211 is disposed in the sealed space. The cover 233 has a plurality of openings 2331 such as a first opening and a second opening. A second end of the first lead and a second end of the second lead penetrate respectively the first opening and the second opening. Thus the second ends of the leads 215 may extend outside of the ceramic case 230.

Since the surge absorber 211 may be disk-shaped, the surge absorber 211 clad with the coating 217 may be the same shape having two surfaces and an edge as shown in the FIG. 2 (*a*). The surge absorber 211 is accommodated in the container 231 and fixed by an adhesive 251. The adhesive 251 may be epoxy dispensed respectively on the two opposite surfaces of the coating 217 as shown in FIG. 2 (*b*), or dispensed at the edge of the coating 217 as shown in FIG. 2 (*c*).

A preferred method for producing the surge absorber 211 comprises powder preparation of Zinc Oxide (ZnO), Bismuth Oxide ($Bi_2O_3$), and Antimony Oxide ($Sb_2O_3$), dry-pressing forming the prepared powder, sintering the formed power into a metal oxide at a first predetermined temperature, electroplating the electrodes 213 on surfaces of the metal oxide, forming the leads 215 corresponding to the electrodes 213, soldering the leads 215 respectively to the electrodes 213 with silver pastes, dip coating or spray coating the metal oxide in phenolic resin to form the coating 217 and curing the coating 217 by light.

A preferred method for producing the ceramic case 230 comprises powder preparation of Aluminum Oxide ($Al_2O_3$), Silicon dioxide ($SiO_2$), Magnesium Oxide (MgO) and other compound, dry-pressing forming the prepared powder, and sintering the formed power into a ceramic case at a second predetermined temperature.

After making the ceramic case 230 and the surge absorber 211, placing the surge absorber 211 enrobed with the coating 217 dispensed the adhesive 251 into the container 231, and disposing the cover 233 on the container 231 with the leads 215 extending from the openings 2331.

The leads 215 are configured to conduct surge current to the surge absorber 211 and made from copper wires or copper alloy wires. The surge absorber 211 is configured to conduct the surge current and convert the surge current into heat. When surge current instantly passes through the surge absorber 211 within micro-seconds, the temperature of the surge absorber 211 would be increased and possibly reached a failure temperature which is the boiling point of the silver pastes. Then the surge absorber 211 would be break with the leads 215 and become invalid, moreover the coating would be burned.

A major feature of the present invention is the ceramic case 230 may function as a protector of the varistor 200 from explosion or flaming when the surge absorber 211 is ineffective due to overloading or worsening of material. In general, the first predetermined temperature is higher than the failure temperature of the surge absorber 211. Since the ceramic case 230 is sintered at the second predetermined temperature higher than the first predetermined temperature related to the sintering temperature of the surge absorber 211, the second predetermined temperature is higher than the failure temperature of the surge absorber 211 accurately. Thus the ceramic case 230 remains good mechanical strength even the surge absorber 211 is overload and ineffective.

The failure temperature is about 700° C. to 800° C. or higher. In one implement, the first predetermined temperature is in a rage of 900° C. to 1300° C. and the second predetermined temperature is 1150° C. to 1600° C. In another implement, the first predetermined temperature is in a rage of 900° C. to 1250° C. and the second predetermined temperature is 1150° C. to 1350° C. The ceramic case 230 may durable for at least 5 minutes at 800° C. or higher after the silver pastes vaporize. Therefore, the surge absorber 211 may be powerfully clamped within the ceramic case 230 and the varistor 200 would remain its construction without breakdown, burning or explosion.

The mechanical properties of a material depend on its composition. The composition of the surge absorber 211 may comprises 90 wt. % ZnO, 4 wt. % $Bi_2O_3$, 3 wt. % $Sb_2O_3$ and 3 wt. % other compound. The material of coating 217 may be phenolic resin such as silicone resin, epoxy resin or a mixture thereof.

The ceramic case 230 made from $Al_2O_3$ performs good mechanical strength at high temperature In one implement, the ceramic case 230 includes about 25 to 99 wt. % $Al_2O_3$ and 1 to 75 wt. % $SiO_2$, MgO and other compound.

In another implement, the composition of the ceramic case 230 includes about 15 to 60 wt. % $SiO_2$ and 40 to 85 wt. % $Al_2O_3$, MgO and other compound. For example, the ceramic case 230 comprises 18 wt. % $SiO_2$, 75 wt. % $Al_2O_3$, 4 wt. % MgO and 3 wt. % other compound Another proper composition of the ceramic case 230 includes about 15 to 40 wt. % MgO and 60 to 85 wt. % $Al_2O_3$, $SiO_2$ and other compound.

Figure 3A:
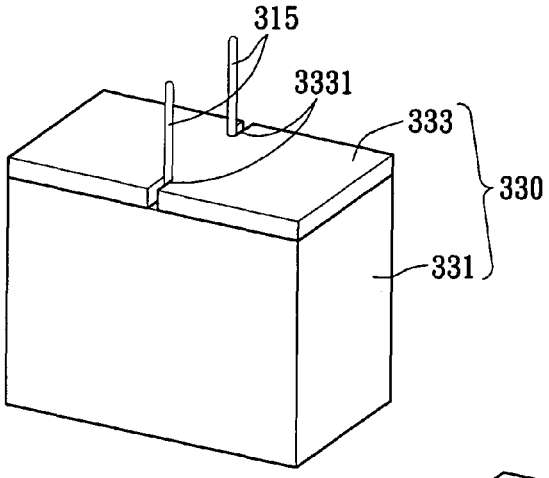
FIGS. 3*a*, 3*b* and 3*c* are a schematic diagrams of a ceramic case of the varistor in accordance with one embodiment of the present invention.
Figure 3B:
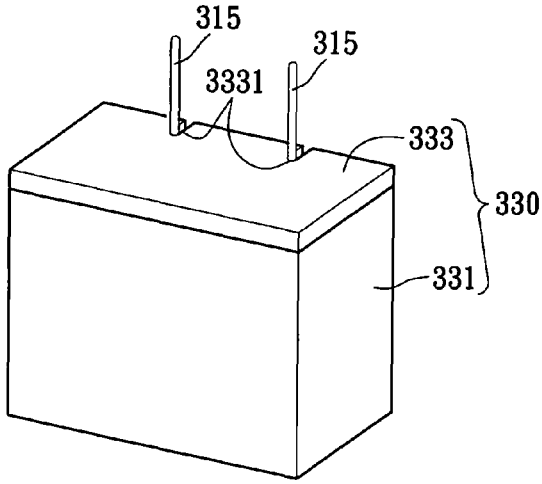
Figure 3C:
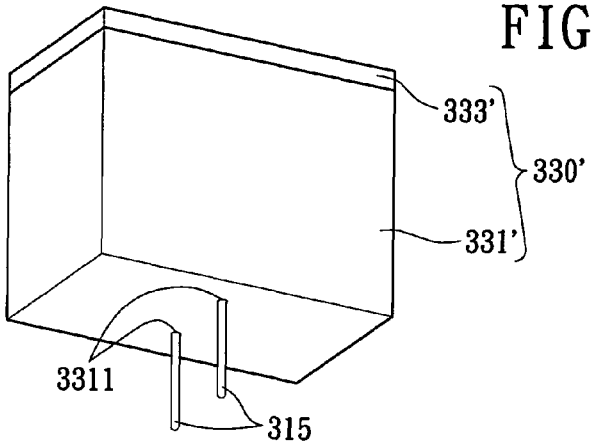

FIG. 3 is a schematic diagram of the ceramic case of the varistor in accordance with one embodiment of the present invention.

Types and positions of the openings may be arranged optionally for the leads extending from the ceramic case. FIG. 3 illustrates different assemblies of the container and the cover. In FIG. 3(*a*), the ceramic case 330 includes a container 331 and a cover 333. The cover 333 is attached on the container 331 to form a space. Two openings 3331 are respectively formed on opposite edges of the cover 333 and the two leads 315 may protrude from the openings 3331. In FIG. 3(*b*), two openings 3331 are formed on the same edge of the cover 333, and the two leads 315 may protrude from the openings 3331. In FIG. 3(*c*), the ceramic case 330' comprises a container 331' and a cover 333'. The cover 333' is disposed on the container 331' to from an accommodation. The cover 333' has smooth edges, and two openings 3311 are formed beneath the container 331'. With respective to the other embodiments, the ceramic absorber (not shown) is placed up side down for the two leads 315 respectively protruding from the openings 3311.

It is worth noting that the number of the leads and the openings are adjustable and not limited by the illustration in FIG. 2 and FIG. 3.

Figure 4A:
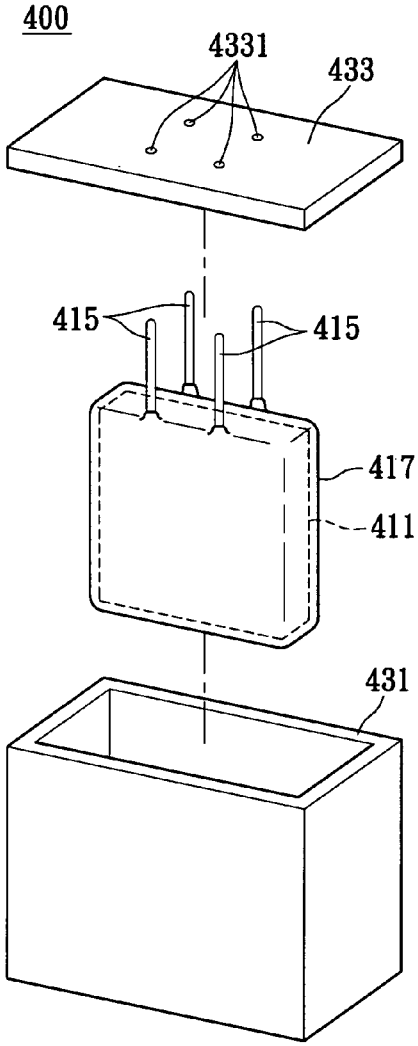
FIGS. 4*a*, 4*b* and are a schematic diagrams of the varistor in accordance with a second embodiment of the present invention.
Figure 4B:
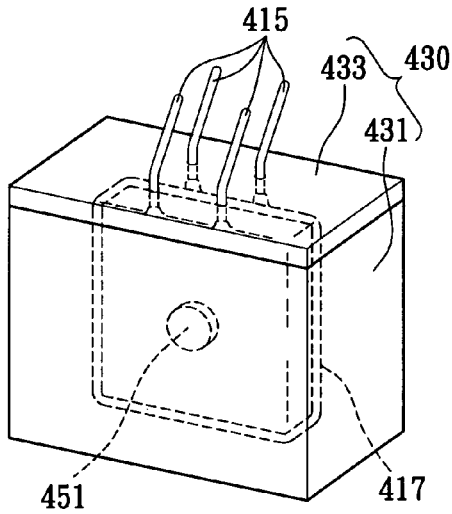
Figure 4C:
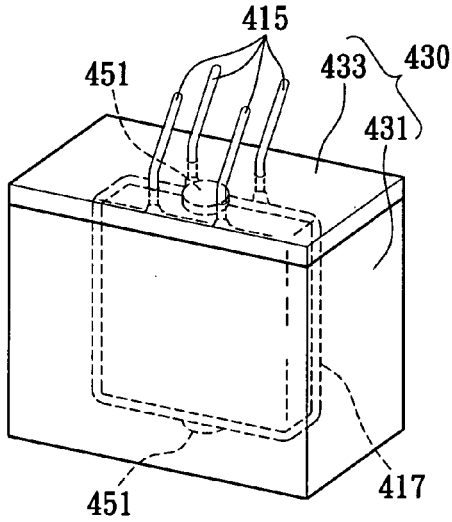

FIG. 4 is a schematic diagram of the varistor in accordance with a second embodiment of the present invention. The varistor 400 comprises a surge absorber 411, a coating 417, a plurality of leads 415, an adhesive 451 and a ceramic case 430. The surge absorber 411 may be a two-layered or a three-layer structure in a cube-shaped. When the surge absorber 411 is the two-layered structure, the surge absorber 411 has three electrodes and the plurality of leads 415 comprises three leads. First ends of the leads 415 respectively attached to the three electrodes.

When the surge absorber 411 is the three-layered structure, the surge absorber 411 has four electrodes and the plurality of leads 415 comprises four leads. First ends of the leads 415 respectively attached to the four electrodes.

The ceramic case 430 has a plurality of openings 4331 for second ends of the leads 415 to extend outside of the ceramic case 430. The ceramic case 430 comprises a container 431 and a cover 433. The cover 433 is connected to the container 431 for accommodating the surge absorber 411 clad with the coating 417. The openings 4331 are located on the cover 433 or the container 431 corresponding to the leads 415.

The surge absorber 411 is accommodated in the container 431 and fixed by an adhesive 451. The adhesive 451 may be epoxy dispensed respectively on the opposite cubic side of the coating 417 as shown in FIG. 4 (*b*), or in FIG. 4 (*c*).

Figure 5A:
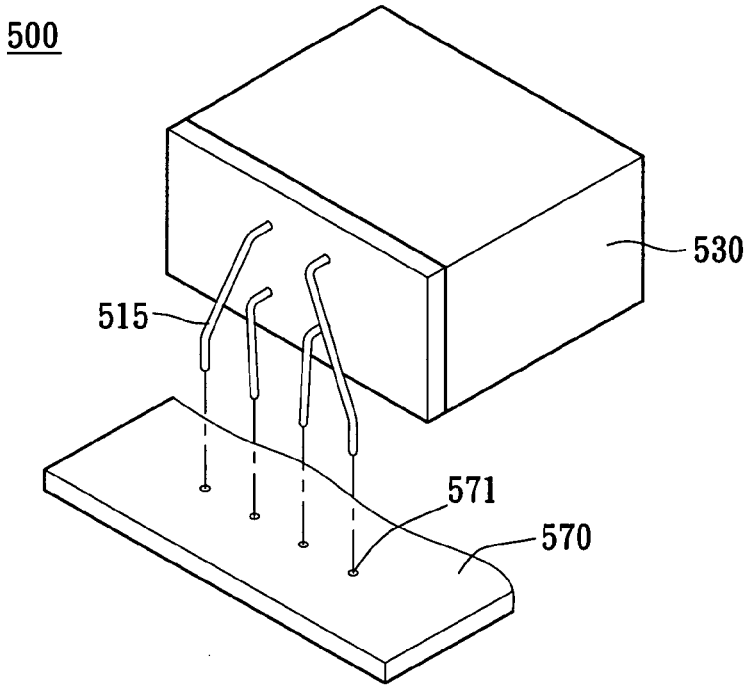
FIGS. 5*a*, 5*b* and are a schematic diagrams of the varistor in accordance with a third embodiment of the present invention.
Figure 5B:
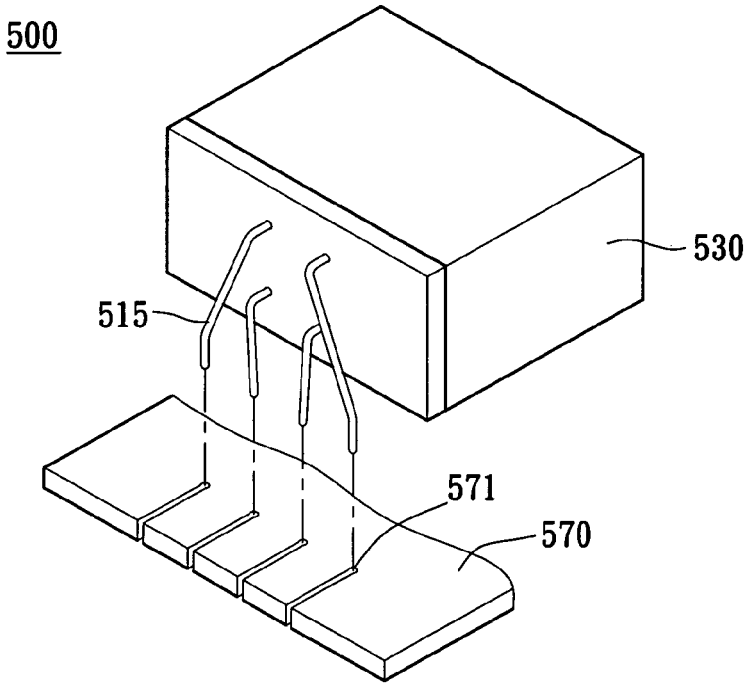

FIG. 5 is a schematic diagram of the varistor in accordance with a third embodiment of the present invention.

The difference between varistor 500 and the varistor 400 in FIG. 4 is that the varistor 500 further comprises a fixed plate 570. In FIG. 5, only ceramic case 530 and leads 515 are illustrated. The fixed plate 570 is disposed close to the ceramic case 530 and has a plurality of channels 571. The plurality of channels 571 are separated by equal intervals and arranged in a row.

Because the leads 515 are made from copper wires or copper alloy wires, second ends of the leads 515 are flexible to be bended in any direction. When the second ends of the leads 515 are bended in vertical direction with respect to the ceramic case 530 and penetrate respectively the channels 571, the ceramic case 530 may be horizontally installed on a printed circuit board. The channels 571 may be a plurality of holes as shown in FIG. 5 (*a*), or a plurality of slots as shown in FIG. 5 (*b*).

To sum up, the present invention varistor utilizes the ceramic case served as a protector and fabricated by sintering at higher temperature than the sintering temperature of the surge absorber so as to prevent the varistor from burning.

What are disclosed above are only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention.

What is claimed is:

1. A varistor comprising:

a surge absorber sintered at a first predetermined temperature and having a first electrode and a second electrode;

a first lead having a first end and a second end thereof, wherein the first end connected to the first electrode;

a second lead having a first end and a second end thereof, wherein the first end connected to the second electrode;

a coating enrobing the surge absorber and the first ends of the first lead and the second lead; and a ceramic case sintered at a second predetermined temperature higher than the first predetermined temperature, housing the surge absorber and the coating, having a first opening and a second opening, and made of Magnesium Oxide (MgO), Silicon dioxide ($SiO_2$) and 25 to 99 weight percent Aluminum Oxide ($Al_2O_3$), wherein the second ends of the first lead and the second lead penetrate respectively the first opening and the second opening.

2. The varistor as claimed in claim 1, wherein the first predetermined temperature is in a range of 900 Celsius degrees to 1300 Celsius degrees and the second predetermined temperature is in a range of 1150 Celsius degrees to 1600 Celsius degrees.

3. The varistor as claimed in claim 1, wherein the surge absorber comprises 90 weight percent Zinc Oxide (ZnO), 4 weight percent Bismuth Oxide ($Bi_2O_3$), 3 weight percent Antimony Oxide ($Sb_2O_3$) and 3 weight percent other compound, the coating is silicone resin, and the coating is applied to the surge absorber by spraying or dipping.

4. The varistor as claimed in claim 1, further comprising an adhesive bonding the coating and the ceramic case, wherein the adhesive is epoxy and is dispose on the opposite surface of the surge absorber.

5. The varistor as claimed in claim 1, wherein the ceramic case comprises a container and a cover, wherein the cover is connected to the container and the first opening and the second opening are disposed on the cover or the container opposite to the cover corresponding to the first lead and the second lead.

6. The varistor as claimed in claim 1, further comprising a third lead, wherein the surge absorber further comprises a third electrode, and the third lead having a first end thereof connected to the third electrode and enrobed with the coating, wherein the ceramic case further comprises a third opening and a second end of the third lead penetrate the third opening.

7. The varistor as claimed in claim 6, further comprising a fourth lead, wherein the surge absorber further comprises a fourth electrode, and the fourth having a first end thereof connected to the fourth electrode and enrobed in the coating, wherein the ceramic case further comprises a fourth opening and a second end of the fourth lead penetrate the fourth.

8. The varistor as claimed in claim 7, wherein the second ends of the first lead, the second lead, the third lead and the fourth lead are bended in vertical direction with respect to the ceramic case.

9. The varistor as claimed in claim 8, further comprising a fixed plate closed to the ceramic case and having a plurality of channels separated by equal intervals, wherein the bended second ends of the first lead, the second lead, the third lead and the fourth lead penetrate respectively each channel for extending to a printed circuit board.

10. The varistor as claimed in claim 9, wherein the channels are holes or slots.

11. A varistor comprising:

a surge absorber sintered at a first predetermined temperature and having a first electrode and a second electrode;

a first lead having a first end and a second end thereof, wherein the first end connected to the first electrode;

a second lead having a first end and a second end thereof, wherein the first end connected to the second electrode;

a coating enrobing the surge absorber and the first ends of the first lead and the second lead; and a ceramic case sintered at a second predetermined temperature higher than the first predetermined temperature, housing the surge absorber and the coating, having a first opening and a second opening, and made of Aluminum Oxide ($Al_2O_3$), Magnesium Oxide (MgO) and 15 to 60 weight percent Silicon dioxide ($SiO_2$), wherein the second ends of the first lead and the second lead penetrate respectively the first opening and the second opening.

12. The varistor as claimed in claim 11, wherein the first predetermined temperature is in a range of 900 Celsius degrees to 1250 Celsius degrees and the second predetermined temperature is in a range of 1150 Celsius degrees to 1350 Celsius degrees.

13. The varistor as claimed in claim 11, wherein the surge absorber comprises 90 weight percent Zinc Oxide (ZnO), 4 weight percent Bismuth Oxide ($Bi_2O_3$), 3 weight percent Antimony Oxide ($Sb_2O_3$) and 3 weight percent other compound, the coating is silicone resin, and the coating is applied to the surge absorber by spraying or dipping.

14. The varistor as claimed in claim 11, further comprising an adhesive bonding the coating and the ceramic case, wherein the adhesive is epoxy and is dispose on the opposite surface of the surge absorber.

15. The varistor as claimed in claim 11, wherein the ceramic case comprises a container and a cover, wherein the cover is connected to the container and the first opening and the second opening are disposed on the cover or the container opposite to the cover corresponding to the first lead and the second lead.

16. The varistor as claimed in claim 11, further comprising a third lead, wherein the surge absorber further comprises a third electrode, and the third lead having a first end thereof connected to the third electrode and enrobed with the coating, wherein the ceramic case further comprises a third opening and a second end of the third lead penetrate the third opening.

17. The varistor as claimed in claim 16, further comprising a fourth lead, wherein the surge absorber further comprises a fourth electrode, and the fourth having a first end thereof connected to the fourth electrode and enrobed in the coating, wherein the ceramic case further comprises a fourth opening and a second end of the fourth lead penetrate the fourth.

18. The varistor as claimed in claim 17, wherein the second ends of the first lead, the second lead, the third lead and the fourth lead are bended in vertical direction with respect to the ceramic case.

19. The varistor as claimed in claim 18, further comprising a fixed plate closed to the ceramic case and having a plurality of channels separated by equal intervals, wherein the bended second ends of the first lead, the second lead, the third lead and the fourth lead penetrate respectively each channel for extending to a printed circuit board.

20. The varistor as claimed in claim 19, wherein the channels are holes or slots.

21. A varistor comprising:

a surge absorber sintered at a first predetermined temperature and having a first electrode and a second electrode;

a first lead having a first end and a second end thereof, wherein the first end connected to the first electrode;

a second lead having a first end and a second end thereof, wherein the first end connected to the second electrode;

a coating enrobing the surge absorber and the first ends of the first lead and the second lead; and a ceramic case sintered at a second predetermined temperature higher than the first predetermined temperature, housing the surge absorber and the coating, having a first opening and a second opening, and made of Aluminum Oxide ($Al_2O_3$), silicon dioxide ($SiO_2$) and 15 to 40 weight percent magnesium oxide (MgO), wherein the second ends of the first lead and the second lead penetrate respectively the first opening and the second opening.

22. The varistor as claimed in claim 21, wherein the first predetermined temperature is in a range of 900 Celsius degrees to 1250 Celsius degrees and the second predetermined temperature is in a range of 1150 Celsius degrees to 1350 Celsius degrees.

23. The varistor as claimed in claim 21, wherein the surge absorber comprises 90 weight percent Zinc Oxide (ZnO), 4 weight percent Bismuth Oxide ($Bi_2O_3$), 3 weight percent Antimony Oxide ($Sb_2O_3$) and 3 weight percent other compound, the coating is silicone resin, and the coating is applied to the surge absorber by spraying or dipping.

24. The varistor as claimed in claim 21, further comprising an adhesive bonding the coating and the ceramic case, wherein the adhesive is epoxy and is dispose on the opposite surface of the surge absorber.

25. The varistor as claimed in claim 21, wherein the ceramic case comprises a container and a cover, wherein the cover is connected to the container and the first opening and the second opening are disposed on the cover or the container opposite to the cover corresponding to the first lead and the second lead.

26. The varistor as claimed in claim 21, further comprising a third lead, wherein the surge absorber further comprises a third electrode, and the third lead having a first end thereof connected to the third electrode and enrobed with the coating, wherein the ceramic case further comprises a third opening and a second end of the third lead penetrate the third opening.

27. The varistor as claimed in claim 26, further comprising a fourth lead, wherein the surge absorber further comprises a fourth electrode, and the fourth having a first end thereof connected to the fourth electrode and enrobed in the coating, wherein the ceramic case further comprises a fourth opening and a second end of the fourth lead penetrate the fourth.

28. The varistor as claimed in claim 27, wherein the second ends of the first lead, the second lead, the third lead and the fourth lead are bended in vertical direction with respect to the ceramic case.

29. The varistor as claimed in claim 28, further comprising a fixed plate closed to the ceramic case and having a plurality of channels separated by equal intervals, wherein the bended second ends of the first lead, the second lead, the third lead and the fourth lead penetrate respectively each channel for extending to a printed circuit board.

30. The varistor as claimed in claim 29, wherein the channels are holes or slots.

* * * * *